US006279315B1

(12) United States Patent
Harju

(10) Patent No.: US 6,279,315 B1
(45) Date of Patent: Aug. 28, 2001

(54) PNEUMATIC UNLOCKING AND CLOSING APPARATUS

(75) Inventor: Bert Harju, Harads (SE)

(73) Assignee: Safe Net i Harads AB, Harads (SE)

( * ) Notice: Subject to any disclaimer, the term of this patent is extended or adjusted under 35 U.S.C. 154(b) by 0 days.

(21) Appl. No.: 09/155,821

(22) PCT Filed: Apr. 1, 1996

(86) PCT No.: PCT/SE97/00368

§ 371 Date: Oct. 1, 1998

§ 102(e) Date: Oct. 1, 1998

(87) PCT Pub. No.: WO97/37139

PCT Pub. Date: Oct. 9, 1997

(30) Foreign Application Priority Data

Apr. 1, 1996 (SE) ..... 9601261

(51) Int. Cl.[7] ..... F16A 31/02
(52) U.S. Cl. ..... 60/410; 92/134
(58) Field of Search ..... 60/406, 410; 92/134; 49/123

(56) References Cited

U.S. PATENT DOCUMENTS 913,853 * 3/1909 Rowntree ..... 60/410
2,475,701 * 7/1949 Eaton ..... 60/410
2,820,434 * 1/1958 Otto ..... 92/134
3,613,503 10/1971 Phillips .
4,152,870 * 5/1979 Knap ..... 49/123

FOREIGN PATENT DOCUMENTS 0654608 11/1994 (EP) .
1317651 5/1973 (GB) .
1428994 3/1976 (GB) .
1428996 3/1976 (GB) .

* cited by examiner

*Primary Examiner*—F. Daniel Lopez
(74) *Attorney, Agent, or Firm*—Larson & Taylor PLC

(57) ABSTRACT

A pneumatic unlocking and closing apparatus for doors has a soft braking phase at each end position. The apparatus includes a pneumatic piston-cylinder unit having a working chamber acting on a large piston area and a return chamber acting on a piston area which is reduced by the piston rod. The apparatus is operated by a substantially closed pressure actuation system having a compressed air pump creating both a working pressure in the working chamber and a less high counter pressure in the return chamber. The pressure system includes a first or plus tank having a certain predetermined high pressure to act as the working pressure in the working chamber for expelling the piston during the ordinary working stroke thereof; and a second or minus tank into which the air of the working chamber is evacuated when the piston is to be returned to its fully retracted position.

7 Claims, 5 Drawing Sheets

PNEUMATIC UNLOCKING AND CLOSING APPARATUS

The present invention generally relates to a pneumatic piston-cylinder apparatus which is useful for many different purposes where it is desired to provide a reciprocating movement, especially a movement having a soft braking phase at each end position, and the invention is more particularly directed to such an apparatus which saves air power, is operating silently and is capable of operating during a certain period of failure of electric power. A special embodiment of the invention is arranged so as to operate with a substantially closed air system.

The invention has been developed especially as the solution of the problem to provide a quick, safe, effective and cheap apparatus for unlocking and closing of doors, both swinging doors and sliding doors. Special advantages are reached for double sliding doors operating in opposite directions, whereby is meant the type of doors which open in that two door halves are moved sideways apart in opposite directions, and which close in that said door halves are moved sideways towards each other.

In the following the invention will mainly be described in connection to such an application, but it is to be understood that this is not intended to restrict the invention or the field of use of the invention.

Known door unlockers of automatically unlocking type include electrically, hydraulically and pneumatically operating door unlockers, and such door unlockers are generally formed so as to open when a person or an object enters a predetermined scanning field, and to close after the lapse of a predetermined period of time. The present invention is, however, as well useful for the type of doors which open after a button has been pressed. This type of door unlockers are generally formed with some type of jam protection means which makes the door become re-opened if there is some obstacle remaining between the doors when the door starts closing.

Both electric and hydraulic door unlockers of the said type often have a heavy unlocking and closing function, and therefore persons and objects may be hurt or damaged if the jam protection means for some reason should fail, or if there should be any obstacle at some part of the door which has no jam protection means, for instance a door part adjacent the upper edge or the bottom edge of the door. Both types of door unlockers therefore often have to be formed with special control means for varying both the speed and the force of the door movement over the unlocking distance. Such control means makes the known products expensive in manufacture.

In many cases there is used oil filled gears and similar control means for the door unlockers, and this may lead to soiling depending on waste of oil and the existense of oil also may create problems in case of fire, since the oil is inflammable.

Also pneumatic door unlockers, which are in many cases directly operating, give rise to the same problems as electric and hydraulic door unlockers in the sense that they may have great unlocking speeds and great forces of movement, and they sometimes present slamming and hitting noises when the doors stop at their end positions.

Many known door unlockers also are formed so that at least the unlocking function is ceased in case of failure of electric current, whereby the doors remain in their closed and locked positions. In order to make it possible to open the doors in case of fire, considering the fact that fire often leads to failure of current, said doors must be formed with some type of releasing means which can be actuated in case of emergency. In many cases it is necessary to call for an operator for disconnecting the releasing means and this may delay the opening of the doors. Generally such emergency release means are formed so that the doors remain in their open condition after the emergency release means has been actuated, and this may lead to the disadvantage that air is introduced to a fire centre, and this may intensify the fire.

The basis of the invention therefore has been the problem or providing a pneumatic apparatus for reciprocatory actuation of one or more objects, like doors, which apparatus is simple, effective and cheap to manufacture, provides a quick starting movement and a decelerated end movement, preferably in both directions of movement, provides a braking of the speed and a successive reduction of the moment force during at least the last half of the total operation distance, automatically closes the doors in case of failure of electric current, but in which case the doors can easily be opened by the force of one's hands and without the need of using tools, makes it possible to reclose the doors several times even during periods of failure of electric current, may extremely simply be emergency released so that for instance the doors remain open, operates very silently, operates economically by using a substantially closed air system, provides a quick unlocking and a slow and soft closing of the doors, operates with a remarkably low and substantially safe air pressure, gives a great fire safety in combination with full possibility for persons to enter and to leave through doors even at failure of electric current, and other advantages.

According to the invention the pneumatic apparatus, which can be used as an unlocking and closing apparatus, is formed with a pneumatic piston-cylinder unit operating with a substantially closed air system, and in which full force, in the following referred to as operating force, is created in one direction, for instance in the unlocking (opening) direction, and in which the return movement (closing) is made using a substantially less air pressure than the full force pressure, in the following referred to as return force, and in which both the full force movement, or operation movement, and the return movement follows against a counter pressure in the opposite piston chamber of the piston-cylinder unit. Further characteristics and advantages of the invention will be evident from the following detailed specification in which reference will be made to the accompanying drawings.

In the drawings

FIG. 3 shows the doors during the unlocking phase, FIG. 4 shows the doors in fully opened positions, FIG. 5 shows the doors during the closing phase and FIG. 6 shows the doors in fully closed positions.

Figure 1:
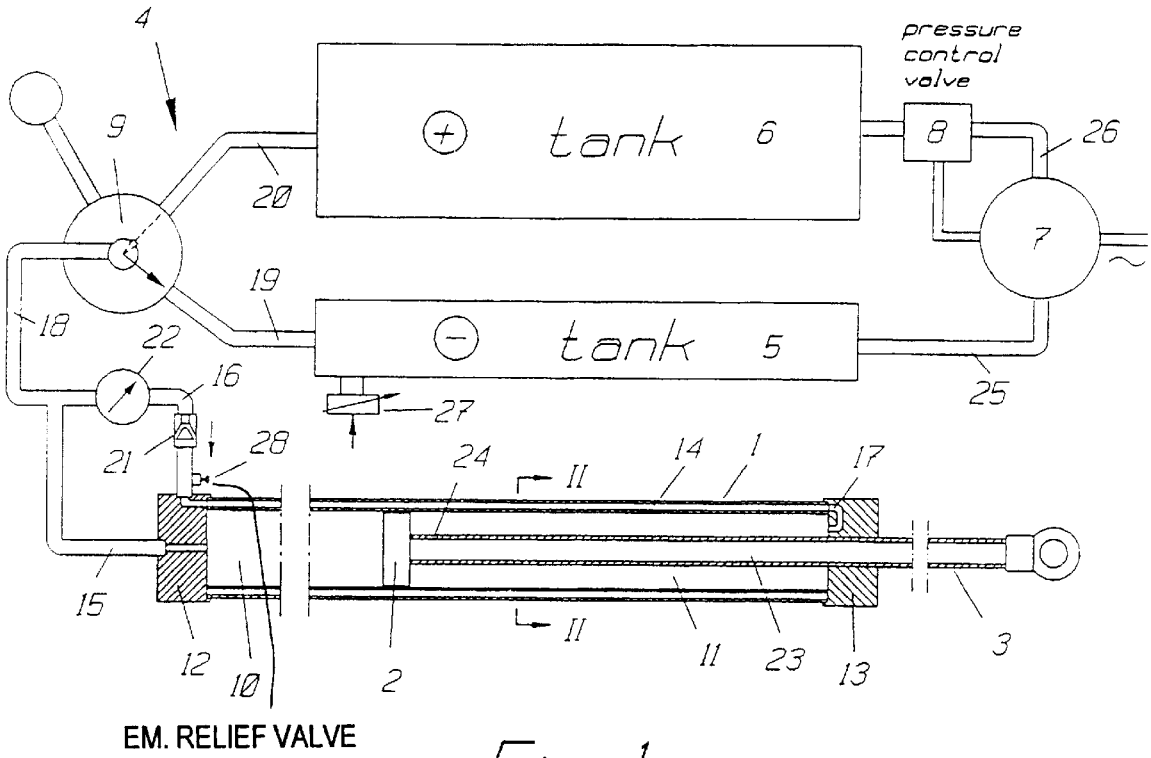
FIG. 1 shows a diagrammatic cross section view through a pneumatic piston-cylinder apparatus according to the invention.

The pneumatic piston-cylinder apparatus shown in FIGS. 1 and 2 generally comprises a piston-cylinder unit having a cylinder 1 with a piston 2 displaceable therein and having a projecting piston rod 3, a pneumatic pressure actuation system 4 comprising a first compressed air tank 5 in the following referred to as –tank (minus tank) and a second compressed air tank 6, in the following referred to as a +tank (plus tank), a compressed air pump 7 including a pressure control means (regulator) 8 which is connected between the –tank 5 and the +tank 6, a valve 9, preferably an electric three way valve which is connected between the –tank 5 and the +tank 6—on one side—and the plus-side or working chamber 10 and the minus-side or return chamber 11 of the piston-cylinder unit 1, 2—on the other side.

Figure 2:
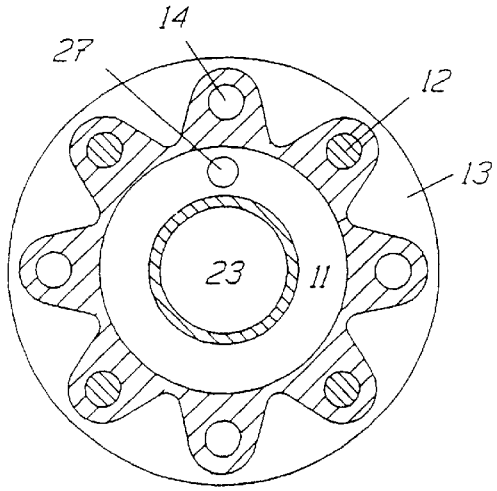
FIG. 2 shows a cross section view along line II—II of FIG. 1.

The piston-cylinder unit is of the known type in which the cylinder part 1 has a star shaped cross section, as shown in FIG. 2, and in which the points of the star has through bores in which mounting bolts 12 can extend for pulling the cylinder part 1 with a front end 12 and a rear end 13 together. Other channels 14 in the points of the star shaped cylinder 1 are used for transmitting compressed air. By this arrangement it is possible to provide the compressed air connections 15 and 16 both for the working chamber (plus side) 10 and the return chamber (minus side) 11 at the same cylinder end, in the illustrated case at the front end 12. For providing a communication between the compressed air connection 16 and the return chamber (minus side) 11 of the cylinder the air channel 14 is connected to a bypass channel 17 at the rear end 13.

The air connection 15 leads directly into the plus chamber 10 of the cylinder. The two air connections 15 and 16 are branched from a common outlet 18 from the valve 9, which valve 9 at the opposite side thereof has a first connection 19 to/from the –tank 5 and a second connection 20 to/from the +tank 6. The valve 9 can be adjusted between two different positions, a first position between the valve outlet 18 and the –tank 5 and a second position between the +tank 6 and the valve outlet 18. The air connection 16 to the minus chamber 11 of the cylinder has a non return valve 21 and a pressure reduction valve 22 mounted therein. The non return valve 21 allows an introduction of compressed air through the air channel 14 to the minus chamber 11 of the cylinder but prevents an air flow out of said minus (return) chamber 11. The pressure reduction valve 22 can be set for any optional pressure to the minus chamber 11, but said pressure is preferably set so that the pressure of the minus (return) chamber 11 is less than the maximum working pressure at the plus side (working chamber) 10.

For increasing the volume of the minus chamber 11 the piston rod preferably can be formed hollow so as to form a piston rod chamber 23. An opening 24 is provided in the piston rod 23 adjacent the piston 2 which allows a free communication between the minus chamber 11 and the piston rod chamber 23.

Between the –tank 5 and the pump 7 there is a conduit 25, and between the pump 7 and the +tank 6 there is a second conduit 26 to which the pressure regulator 8 can be connected. The pressure regulator 8 is connected to the pump 7 so as to start the pump 7 when the pressure of the +tank 6 has decreased to a certain level, and switches the pump 7 off, respectively, when the pressure of the +tank 6 has attained a certain predetermined high pressure level.

The object of the described air pressure apparatus is to provide a working stroke at a relatively high pressure in the working chamber 10 and a return stroke at a relatively lower pressure in the return chamber 11, and to provide an apparatus which operates silently, effectively and economically, and which gives a successively dampened movement in both directions by means of a closed, or substantially closed air system.

The starting position, describing the operation of the apparatus is that the –tank 5 contains air which has been drained from the plus chamber 10 and which has an average high pressure, the +tank 6 has a pressure which is generally higher that of the –tank 5, the return chamber 11 has a return pressure which, in the starting position, is defined by the pressure control valve 21, and which can be referred to as fairly low, for instance a pressure of 1 bar, and the compressed air pump 7 receives air from the –tank 5 over the conduit 25, it compresses said air to a relatively high pressure, for instance 5–6 bar and forces same into the +tank 6 over the conduit 26 whereby the pressure is controlled by the pressure regulator 8.

The operation of the apparatus is as follows

A. Working Stroke

For providing a working stroke the valve 9 is set as marked with the dotted arrow of FIG. 1, in which position the relatively high pressure, for instance 5–6 bar, in the +tank 6 is transmitted through the conduit 20, through the valve 9 and through the conduits 18 and 15 into the working chamber 10 of the piston-cylinder unit. In the starting position the pressure control valve 22 also foresees that there is a fairly low pressure, for instance a pressure of 1 bar, in the minus chamber 11, the air channel 14 and in the piston rod chamber 23. The piston 2 is now moved to the right as shown in FIG. 1. The high pressure of the working chamber 10 creates a quick start of the piston movement, but since the return chamber 11 is closed by the non-return valve 21 the counter pressure of the return chamber 11 will successively increase and reduce the piston speed, so that the piston 2, at the end phase of the working stroke, moves at a slow, dampened speed.

B. Return Stroke

When the piston is to make a return stroke the valve 9 is switched over from the position marked with the arrow of FIG. 1 to the position marked with the full line arrow, whereby the high pressure of the working chamber 10 is drained over the conduits 15, 18 and 19 to the –tank 5. Thanks to the fact that the compressed air is drained into the –tank 5 the draining is made nearly soundless and there is avoided the often high sound of a compressed air blow which otherwise is heard when compressed air is evacuated to the ambient. The draining of air into the –chamber 5 also involves the advantage that the pressure which already exists in the system is utilized by being re-used several times and thereby costs for obtaining compressed air are saved. The pressure from the compressed air in the return chamber 11, the air channel 14 and piston rod chamber 23 is, after the evacuation of air in the working chamber 10, higher than in the working chamber 10, and the piston is moved to the left, as shown in FIG. 1, initially at a relatively high speed, thereafter at a successively reduced speed and with a dampened force as the air of the working chamber 10 and the –tank 5 counteracts the movement, and the piston is stopped slowly and softly in its initial working phase position, from which a new operation cycle can be started.

If the amount of air in the –tank 5 should eventually not be sufficient for filling the +tank 6 with compressed air an amount of supplementary air is received in the –chamber 5 over a non-return valve 27.

The counter pressure in the return chamber 11 at fully retracted position of the piston 2 is so weak in relation to the compressed air pressure in the working chamber 10 and the –chamber 5 that the piston may be expelled "by hand" upon need.

If, for some reason, it should be necessary to expel the piston to its fully expelled position this can be made by means of an evacuation valve 28 in the conduit 16, which valve, by being pressed, evacuates all compressed in the return chamber 11 and the piston rod chamber 23 to the ambient, whereby the pressure in the working chamber 10 and the −tank 5 forces the piston 2 outwards in the cylinder 1. Of course it is possible by letting only part of the compressed air in the return chamber 11 out to have the piston 2 return and to stop in an only partly expelled position, in which the pressures in the working chamber 10 and the return chamber 11 balance each other.

In FIGS. 3–6 there is shown a special field of use for the apparatus shown in FIGS. 1–2, in the form of a door unlocking and closing apparatus.

It is to be understood that said apparatus is only an illustrating example which does not restrict the invention, in said figures the invention is shown applied to twin, oppositely to each other operating sliding doors, but it is obvious that the invention may as well be used for single sliding doors, for swinging doors, for vertically or in another way operating shutters, etc.

In the illustrated case the piston-cylinder apparatus is enclosed in a carrier comprising two spaced pulleys 29, 30 round which an endless belt 31 extends. One of the twin doors 32 is, over a link 33, connected to the lower path of the belt 31, and the second door half 34 is, over another link 35, connected to the upper path of the belt 31. Further, the second link 35 is directly connected to end of the piston rod 3. A displacement of the piston rod 3 therefore makes the twin door halves 32 and 34 move towards each other and apart, respectively.

For making the door halves operate automatically the valve 9, which preferably operates electrically, is connected to a detector 36, which can be a photo cell, an IR detector and/or a sound or light detector. The detector 36 is connected to a timer 37 which defines the time during which the doors 32, 34 are to be kept open.

The operation of the door unlocker/closer is the same a described in connection to FIGS. 1 and 2. A preferred pressure for unlocking of twin sliding doors can be 5–6 bar as opening pressure in the working chamber 10 and about 1 bar as uncompressed return pressure in the return chamber 11.

Figure 3:
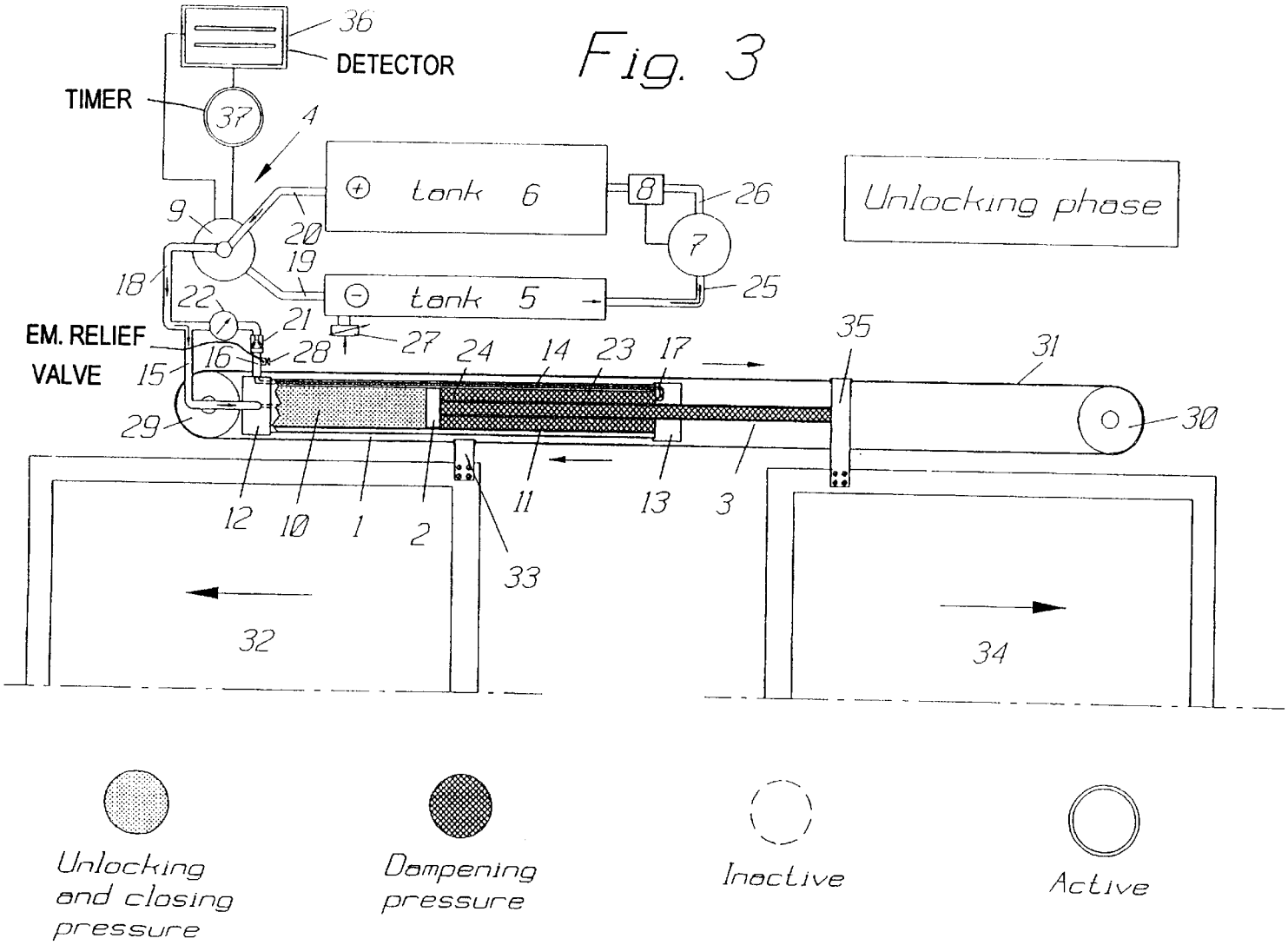
FIGS. 3–6 show an example of a field of use of the piston-cylinder apparatus of the invention in the form of a door unlocking and closing apparatus for twin doors of sliding door type, whereby

FIG. 3 shows the unlocking (opening) phase of the apparatus, which is started when a person or an object enters the scanning zone for the detector 36 which is thereby made active, like also the timer 37 is made active. The valve 9 immediately sets itself in the position to the +tank 6. The decrease of pressure in the +tank 6 makes the pump start and to suck air from the −tank 5, compress said air and to force same into the +tank 6, which puts the working chamber 10 under unlocking pressure over the conduits 20, 18, 15. The piston 2 moves to the right, as shows in FIG. 3, the doors 32 and 34 are moved apart thereby opening the doors, and the air in the return chamber 11 is compressed. The opening movement is counter acted by the increasing counter pressure in the return chamber 11, and the opening phase stops slowly and dampened in the end position.

Figure 4:
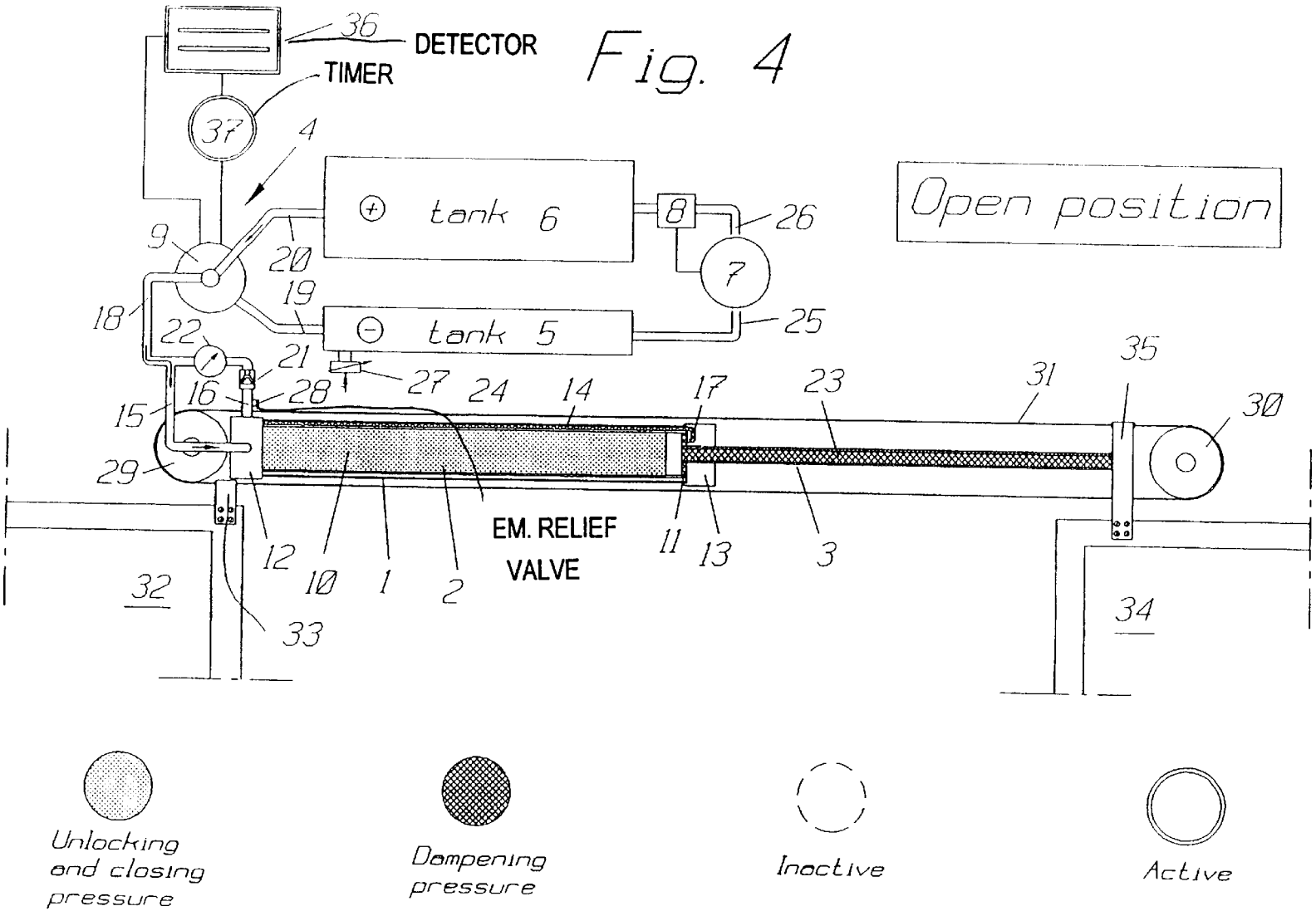

When the doors have been opened completely, as shown in FIG. 4, there is full working pressure in the working chamber 10, and the air in the return chamber 11, in the air channel 14 and in the piston rod chamber 23 is compressed. The doors remain open as long as the detector 36 and the timer are active. The time during which the doors remain open can be varied as desired.

Figure 5:
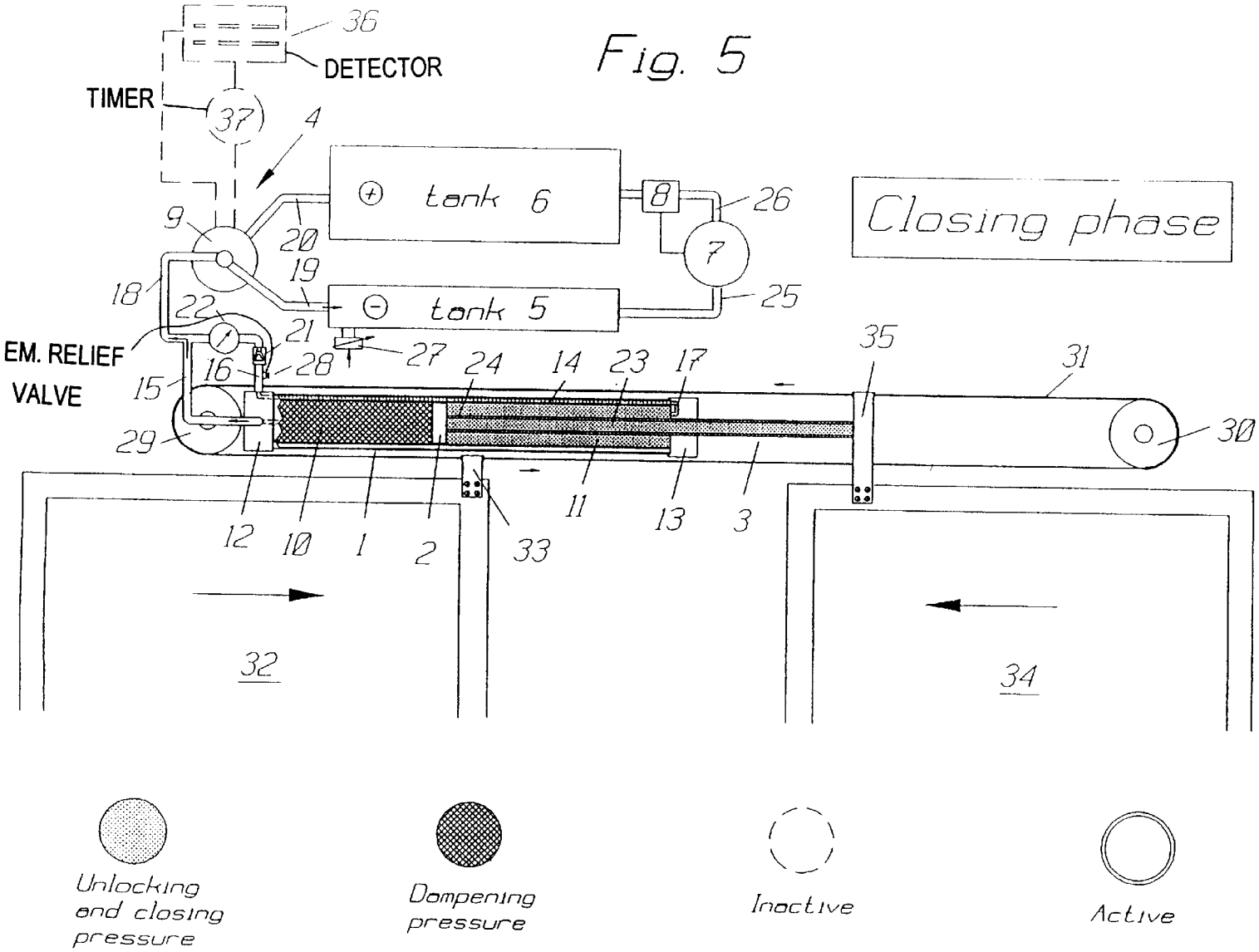

When the set opening time for the timer 37 has come to an end, and there is no obstacle in the scanning area of the detector 36, the valve switches over from the +tank 6 to the −tank 5, as shown in FIG. 5. The working chamber 10 is thereby drained to the −tank 5. Depending on the pressure reduction in the working chamber 10 the piston 2 starts moving in the closing direction—against the action of the pressure which is present in the working chamber 10, in the conduits 15, 18 and 19 and in the −tank 5. The return movement starts relatively quickly but is successively decelerated adjacent the end of the return movement as the air in the working chamber 10 and in the −tank 5 is compressed depending on the closing movement of the piston 2.

Figure 6:
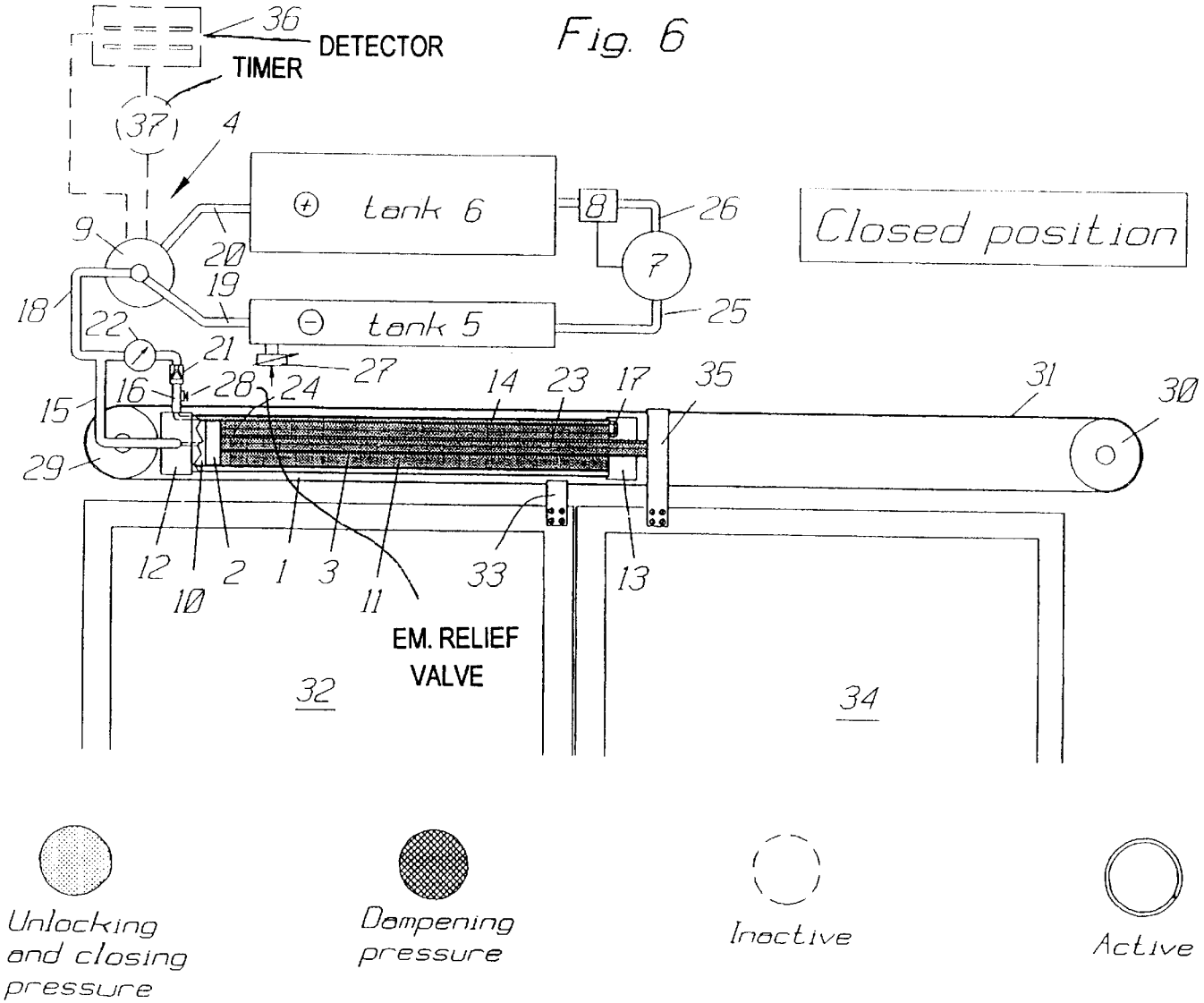

When the door has been completely closed, which position is shown in FIG. 6, there is a certain counter pressure in the working chamber 10 and in the −tank 5 and a pressure of about 1 bar in the return chamber 11, in the air channel 14 and in the piston rod chamber 23. Said last mentioned pressure keeps the doors closed by a certain force, which force in not stronger than making it possible to open the doors "by the hands", and the pressure is so low that no substantial damage will appear in case a person or an object, in spite of the great scanning area of the detector 36, should happen to be present between the doors.

If there should happen to be an electric power failure the operation of the detector 36, the timer 37 and the pump 7 ceases, and the doors thereby remain closed. Thanks to the relatively weak closing pressure in the return chamber 11 it is possible, as mentioned above, to open the doors "by the hands", and thanks to the closed air system the doors reclose as soon as they are let free. This can be of great importance in case of a fire in that persons can leave through the doors, and that the doors reclose after said persons have passed, and it is thereby prevented that air from outside enters the centre of the fire.

The pressures in the chambers 10, 11 and 23 and in the tanks 5 and 6 are sufficient for making it possible to open and reclose the doors several times in case of an electric power failure. Depending on leakage of air the said pressures, however, may be slightly reduced.

If, for some reason, it should be desired to keep the doors open in case of an electric power failure, or for another reason, this is possible by pressing the evacuation valve 28, whereby the pressure of the return chamber 11, in the air channel 14 and in the piston rod chamber 23 is drained. Said evacuation valve 28 acts as an emergency releasing means. The remaining pressure in the −tank 5 and in the working chamber 10 thereby makes the doors remain open.

As soon as the electric current is switched on again the pump 7 starts operating, the valve 9 switches towards the +tank 6, the return chamber 11 and the piston rod chamber 23 are supplied with the low pressure of for instance 1 bar, and as soon as the detector 36 and the timer 37 become inactive the doors are closed again.

It is, of course, also possible to combine the above described belt movement of the door unlocker with some type of known belt gear thereby creating a desired profile of movement and a desired force when the doors are being opened and closed, respectively.

What is claimed is:

1. Pneumatic unlocking and closing apparatus providing a movement having a soft braking phase at each end position, said apparatus comprising:

a pneumatic piston-cylinder unit having a working chamber acting on a large piston area and a return chamber acting on a piston area which is reduced by an area of a piston rod, and a pressure actuation system which operates said unit, the pressure actuation system being formed as a substantially closed pressure system having a compressed air pump arranged to create both a relatively high working pressure in the working chamber and a less high counter pressure in the return chamber, a first plus pressure tank having a predetermined high pressure adapted to act as the working pressure in the working chamber thereby expelling the piston during the working stroke thereof, and a second minus pressure tank having a pressure which is less than the pressure of the plus tank, and into which the air of the working chamber is evacuated for returning the piston to its fully retracted position; and wherein the return chamber is connected to the working chamber via a pressure reduction valve giving the return chamber a certain predetermined pressure which is less than the working pressure in the working chamber when the piston is fully retracted, via a non-return valve which prevents unintentional evacuation of the pressure in the return chamber, and via an emergency release valve by which the pressure in the return chamber may be evacuated in an emergency.

2. Apparatus according to claim 1, wherein the return chamber is arranged to be pressurised with the certain pressure by said non-return valve which prevents an evacuation of the air in the return chamber, and whereby the air in the return chamber is compressed when the piston is being expelled out of the cylinder during the working stroke thereof.

3. Apparatus according to claim 1, wherein the compressed air pump is mounted between the minus tank and the plus tank, which said air pump receives air from the minus tank, compresses said air and forces the compressed air into the plus tank, and in which the level of the air pressure in the plus tank (6) is controlled by a pressure regulator.

4. Apparatus according to claim 1, further including a valve mounted (a) between the minus tank and the plus tank and (b) the working chamber (10) of the piston-cylinder unit, which said valve takes two different positions, namely a first position in which the plus tank is connected to the working chamber thereby executing the working stroke, and a second position in which the working chamber is connected to the minus tank thereby at least partly evacuating the pressure of the working chamber to the minus tank to initiate the return movement of the piston in the cylinder.

5. Apparatus according to claim 4, used for door unlockers, wherein the apparatus further comprises a detector having a predetermined scanning area and being connected to the valve between (a) the minus tank and the plus tank and (b) the working chamber of the piston-cylinder unit such that said detector provides a connection of the plus tank to the working chamber as soon as an object enters the scanning area of the detector, and so as to connect the working chamber to the minus tank after said object has left the scanning area of the detector.

6. Apparatus according to claim 5, wherein the detector co-operates with a timer which keeps the door or doors open for a predetermined period of time after the object has left the scanning area of the detector.

7. Apparatus according to claim 5, used as an unlocking and closing apparatus for sliding twin doors operating in opposite directions, wherein the piston rod, over a link connected to a first one of the twin door, is connected to one path of a belt extending over two pulleys, and in that a second one of the twin door is connected to a second path of the belt, whereby the two door, concurrently and with the same speed, are moved apart and towards each other, respectively, when the piston n displaced in the cylinder.

* * * * *

UNITED STATES PATENT AND TRADEMARK OFFICE

CERTIFICATE OF CORRECTION

PATENT NO. : 6,279,315 B1
DATED : August 28, 2001
INVENTOR(S) : Harju

It is certified that error appears in the above-identified patent and that said Letters Patent is hereby corrected as shown below:

Title page,
Correct the date shown in [22] as follows:
[22] PCT Filed: Mar. 4, 1997

Signed and Sealed this

Twenty-sixth Day of February, 2002

*Attest:*

*Attesting Officer*

JAMES E. ROGAN
*Director of the United States Patent and Trademark Office*